United States Patent [19]

Santiago

[11] Patent Number: 5,074,466

[45] Date of Patent: Dec. 24, 1991

[54] FLUID VALVE STEM FOR AIR SPRAY GUN

[75] Inventor: Orlando Santiago, Streamwood, Ill.

[73] Assignee: Binks Manufacturing Company, Franklin Park, Ill.

[21] Appl. No.: 464,950

[22] Filed: Jan. 16, 1990

[51] Int. Cl.[5] ..... B05B 7/08

[52] U.S. Cl. ..... 239/8; 239/296; 239/414; 239/417.3; 239/DIG. 14

[58] Field of Search ..... 239/8, 296, 299, 300, 239/456, 417, 290, 407–409, 414, 417.3, 417.5, DIG. 14; 251/122; 137/625.33

[56] References Cited

U.S. PATENT DOCUMENTS 3,365,166 1/1968 Smith ..... 251/122

3,561,677 2/1971 Norris ..... 239/290

*Primary Examiner*—Andres Kashnikow

*Assistant Examiner*—Karen B. Merritt

*Attorney, Agent, or Firm*—Juettner Pyle & Lloyd

[57] ABSTRACT

An improved fluid valve stem for an air spray gun has a triangular-shaped forward end extended into a cylindrical fluid outlet passage of a fluid nozzle. The triangular-shaped forward end forms liquid coating material flowing therepast into a hollow cylindrical stream that is emitted from the fluid nozzle and pneumatically atomized into a spray. The hollow stream of coating material is considerably easier to atomize than is a solid stream, so with the result that effective atomization is achieved at low air pressures and volumes for improved transfer efficiency.

23 Claims, 3 Drawing Sheets

Fig. 1
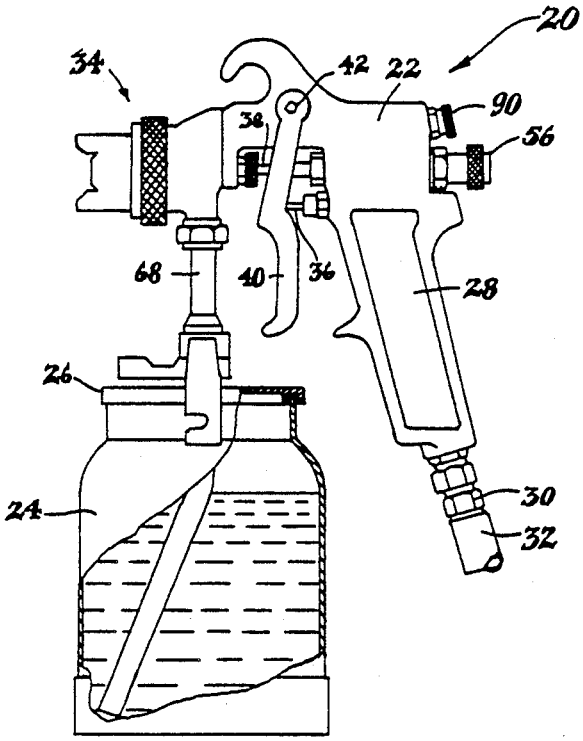
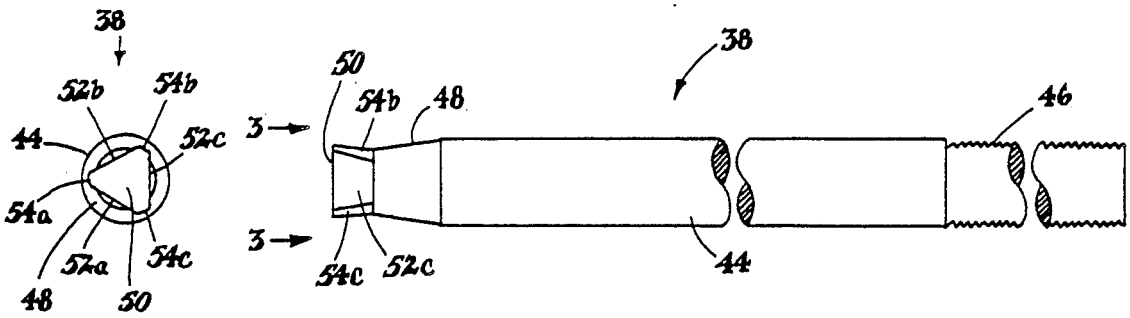
Fig. 3
Fig. 2

FLUID VALVE STEM FOR AIR SPRAY GUN

BACKGROUND OF THE INVENTION

The present invention relates to air spray guns, and in particular to an improved fluid valve stem for an air spray gun that allows effective pneumatic atomization of coating material to be achieved at low air pressures and volumes for increased transfer efficiency.

To decrease the cost of coating material used in spray coating processes and for environmental considerations, there has been a trend toward spray coating equipment having a high transfer efficiency. Transfer efficiency is the amount of coating solids applied onto a target versus the amount of coating solids sprayed, expressed as a percentage. To increase transfer efficiency, the velocity of the coating particles should advantageously be fairly slow in order to avoid blow-by which occurs when spray particles miss the target, with excessive velocity of the particles actually causing some of them that strike the target to bounce off of it. Greatest transfer efficiency is usually achieved in systems offering optimum atomization coupled with the lowest possible velocity of the spray particles.

Conventional air spray guns have a relatively low transfer efficiency. Air delivered to their spray heads has a relatively high pressure and volume, and as it exits the spray head it atomizes a solid cylindrical stream of liquid coating material into a conically-shaped spray, which usually is flattened into a fan-shaped pattern by opposed side port air jets. When the high pressure and high volume air exits the spray head, it expands and imparts a relatively high velocity and fogging effect to the spray particles, causing a large percentage of the particles to miss the target.

Airless spray systems have a somewhat higher transfer efficiency. With such systems, coating liquid is hydraulically forced through a specially shaped orifice at pressures on the order of 500–4500 psi, which causes the coating to be emitted in an unstable thin film that interacts with atmospheric air and breaks up into an atomized spray at its forward edge. These systems develop spray particles that have a lower velocity and exhibit less fogging than occurs with conventional air spray guns.

A more recent development is the air-assisted airless system which utilizes both airless and air atomization. Coating liquid is supplied to a specially shaped orifice at hydraulic pressures less than those normally encountered in purely airless systems, usually on the order of 300–1,000 psi. This causes the material to be atomized into a spray, but the degree of atomization is not as satisfactory as that obtained with conventional airless or air spray guns. To improve atomization, an air-assist is applied to the spray pattern, enhancing the atomization process and doing away with tails that would mar the finish. The transfer efficiency of air-assisted airless systems is greater than those of conventional airless or air spray systems.

Recently, high volume low pressure (HVLP) spray systems have found increasing use because of their high transfer efficiency. These systems utilize air to atomize a stream of coating material, but at the spray head the air has a relatively high flow rate, usually well in excess of 5 CFM, and a relatively low delivery pressure, usually less than 15 psi. The high volume and low pressure of the air results in decreased fogging and an increased percentage of the spray particles striking and adhering to the target.

All of the mentioned spray coating systems have certain disadvantages. Conventional air spray guns have a relatively low transfer efficiency, and although airless and air-assisted airless systems have a higher transfer efficiency, they require separate pumps for delivering liquid coating at the pressures required, which adds to the cost and complexity of the systems. In the case of HVLP spray guns, many require use of a separate turbine to supply air at high volume and low pressure to an inlet to the gun, while others adapted for use with high pressure factory air are usually provided with specially configured and complex air flow paths to ensure that the pressure of air at their spray heads does not exceed a selected maximum value.

OBJECTS OF THE INVENTION

An object of the invention is to provide an improved fluid valve stem for an air spray gun, which configures an emitted stream of coating material to a shape that may be effectively atomized at decreased air pressures and volumes for greater transfer efficiency.

Another object is to provide such a fluid valve stem, which can readily be substituted for a fluid needle valve in a conventional air spray gun.

A further object is to provide such a fluid valve stem, which causes a hollow cylindrical stream of coating material to be emitted from a fluid orifice of an air spray gun.

SUMMARY OF THE INVENTION

In accordance with the present invention, a method of spraying liquid coating material comprises the steps of emitting a hollow cylindrical stream of liquid coating material from a spray head, and emitting air from the spray head to atomize the hollow cylindrical stream of coating material into a spray.

In a preferred practice of the method, the step of emitting coating material comprises delivering coating material to a fluid valve in the spray head, opening the fluid valve for flow of coating material past the valve and through and out of a cylindrical fluid outlet orifice in the spray head, and configuring the fluid valve to form coating material flowing therepast and through and out of the fluid outlet orifice into a hollow cylindrical stream. The fluid valve has a portion disposed within the fluid outlet orifice, the step of configuring the fluid valve comprises configuring the portion disposed within the fluid outlet orifice to have a generally triangular shape, and the step of opening the fluid valve causes coating material to flow around the triangular-shaped valve portion between the portion and an inner surface of the fluid outlet orifice. Because the stream of coating material is hollow and cylindrical, it can be effectively atomized by air at a relatively low pressure and volume.

The invention also provides an apparatus for spray coating, which comprises a spray head having fluid orifice means and atomizing air orifice means, means for delivering liquid coating material to the fluid orifice means and for emitting the coating therefrom in a hollow cylindrical stream, and means for supplying air to the atomizing air orifice means for emission therefrom to break up the hollow cylindrical stream of coating into an atomized spray.

In a preferred embodiment of the apparatus, the fluid orifice means comprises a fluid nozzle having a fluid inlet passage and a cylindrical fluid outlet passage, and the delivering means delivers coating material to the fluid nozzle inlet passage for flow through and emission from the fluid outlet passage. The delivering means includes fluid shaping means within the fluid nozzle outlet passage for shaping coating material flowing through and emitted from the outlet passage into a hollow cylindrical stream, and the fluid shaping means is triangular in shape.

The invention also contemplates an improved fluid valve for an air atomizing spray gun. The fluid valve comprises an elongate stem having a triangular-shaped forward end, a valve portion rearwardly of the forward end and a rod portion rearwardly of the valve portion. The forward end is triangular-shaped in cross section perpendicular to the length of the stem, and the valve portion comprises a frusto-conical surface on the stem that tapers inwardly toward the forward end of the stem.

The foregoing and other objects, advantages and features of the invention will become apparent upon a consideration of the following detailed description, when taken in conjunction with the accompanying drawings.

BRIEF DESCRIPTION OF THE DRAWINGS

FIG. 1 is a side elevation view of a syphon cup air spray gun assembly, with which the improved fluid valve stem of the invention may advantageously be used;

FIG. 2 is a side view of the improved fluid valve stem;

FIG. 3 is a front view of the fluid valve stem, taken substantially along the lines 3—3 of FIG. 2;

DETAILED DESCRIPTION

Figure 4:
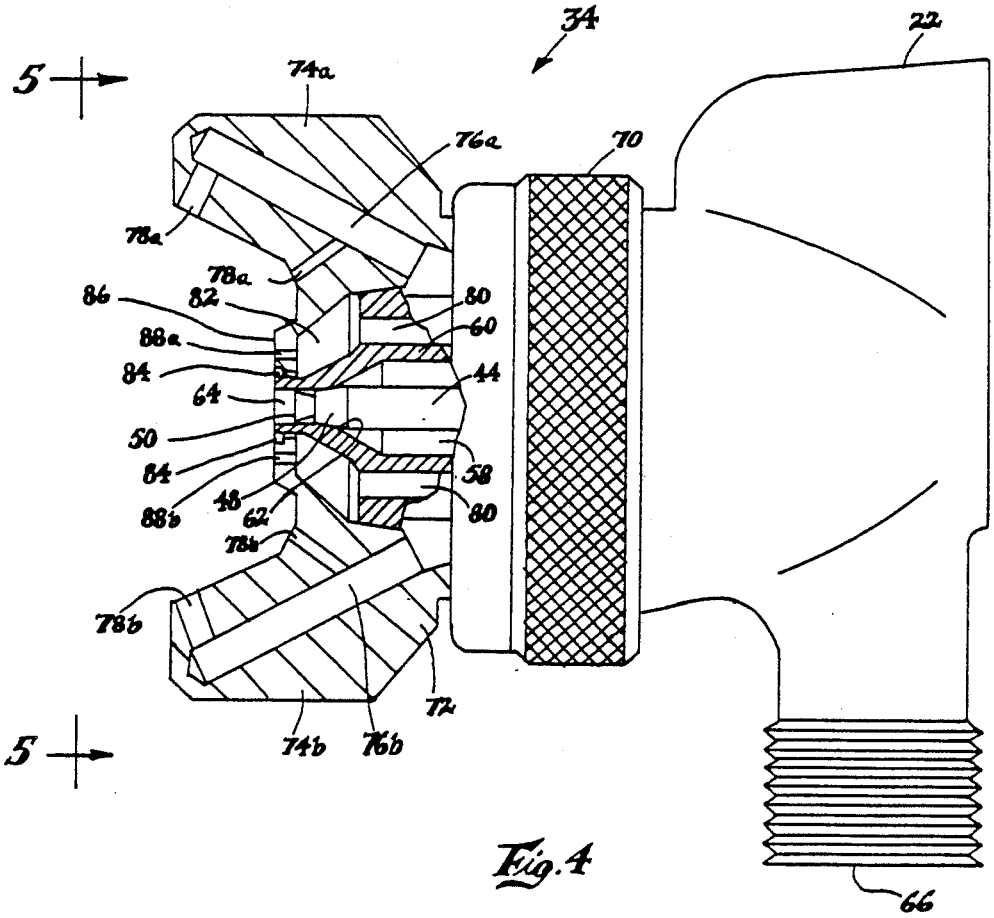
FIG. 4 is a side elevation view, partly in cross-section, illustrating a spray head of the spray gun and showing the fluid valve stem incorporated therein and in its closed position.

FIG. 1 shows a syphon cup type air spray gun assembly, indicated generally at 20, including a spray gun body 22, a paint cup 24 having a supply of liquid coating material therein and a lid 26 which substantially closes the upper end of the cup. A handle 28 is at a rearward end of the gun body, and the lower end of the handle is connected to a source of compressed air (not shown) through a fitting 30 and an air supply line 32. A spray head, indicated generally at 34, is at the forward end of the gun body, and has a fluid outlet orifice from which coating material drawn from the paint cup into the gun body is emitted and pneumatically atomized into a spray.

To control spraying, the gun has an air valve means 36 movable between open and closed positions to control a flow of air through the gun and from the spray head 34, a fluid valve means 38 movable between open and closed positions to control a flow of coating material through the gun and from the spray head, and a manually manipulatable trigger 40 operatively connected with the valve means 36 and 38. The trigger is pivotally mounted at its upper end by a pin 42, and is manually movable between a gun off position away from the handle 28 whereat the valve means 36 and 38 are closed, to a gun on position toward the handle whereat the air and fluid valve means are open.

To the extent described, the spray gun assembly 20 is conventional, and if provided with a conventional fluid valve means, comprising a fluid needle valve having a conically tapered forward end, when triggered on would emit a solid cylindrical stream of coating material from the fluid orifice in the spray head for being pneumatically broken up by atomizing air into a conically expanding spray and, usually, flattened by side port air into a fan-shaped pattern. Because the liquid coating would be emitted in a solid stream, air at a relatively high pressure and volume would be required to satisfactorily atomize it. In consequence, the gun would have a relatively low transfer efficiency, since when the high pressure atomizing air exits the spray head it will expand and impart a relatively high velocity and fogging effect to the spray particles, causing a large percentage of the particles to miss the target.

To improve the transfer efficiency of the spray gun 20, according to the invention the fluid valve means 38 comprises an improved fluid valve stem. As seen in FIGS. 2 and 3, the fluid valve stem 38 has a cylindrical body portion 44 with threads 46 at its rearward end and a conical valve 48 toward its forward end. A forward end 50 of the stem, just forwardly of the conical valve, is configured to be generally triangular-shaped in cross section perpendicular to the length of the stem. The triangular-shaped end is defined by three flats or chords 52*a–c*, the apexes between which are defined by segments 54*a–c*. The particular dimensions of the forward end of the stem depend upon the inside diameter of a cylindrical fluid outlet passage in a fluid nozzle in the spray head 34 into which the forward end of the needle valve stem is extended. For example, for a fluid outlet passage having a 0.110" ID, the apexes 54*a–c* would lie on a circle having a diameter of 0.1095" and the centers of the chords would lie 0.010" radially inwardly from the circle.

Figure 5:
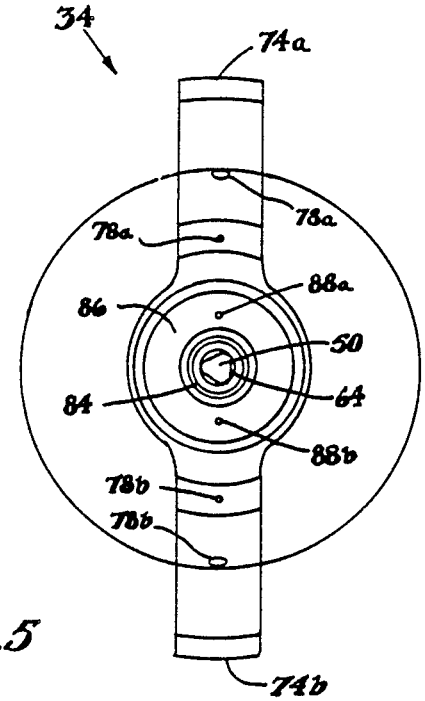
FIG. 5 is taken substantially along the lines 5—5 of FIG. 4, and shows the forward end of the spray head.

As shown in FIGS. 4 and 5, the fluid valve stem 38 is carried within the spray gun 20 in a generally conventional manner, with the threaded rearward end 46 of the stem being coupled with a fluid flow control knob 56 (FIG. 1), the adjustment of which determines the amount of retraction of the stem and therefore the flow rate of coating material emitted from the gun when the gun is triggered on. The forward end of the body portion 44 of the fluid valve stem extends through a fluid inlet passage 58 in a fluid nozzle 60 of the spray head 34, with the valve 48 of the stem being adapted for movement against and away from a valve seat 62 in the fluid nozzle and with the forward end 50 of the stem extended into a cylindrical fluid outlet passage or orifice 64 from the fluid nozzle. The configuration of the stem forward end is such that it is triangular-shaped in cross section perpendicular to the length of the fluid outlet passage, and with the aforementioned dimensions of fluid outlet passage and stem forward end, the apexes 54*a–c* of the forward end are spaced slightly from the inside surface of the fluid outlet passage, but are nevertheless sufficiently close to the surface to maintain the stem in substantial coaxial alignment with the fluid outlet passage.

The fluid inlet passage 58 through the fluid nozzle 60 communicates with a fluid inlet 66 to the gun body 22, to which inlet the contents of the paint cup 24 are delivered through a tube 68 (FIG. 1). Surrounding the fluid nozzle and held onto the forward end of the gun body by a retainer 70 is an air cap 72. The air cap has a pair of diametrically opposed horns 74*a–b*, through which extend respective air passages 76*a–b* that are supplied with air upon opening of the air valve means 36. Leading outwardly from the air passages are respective pairs of diametrically opposed side port air orifices 78*a–b*.

A plurality of air passages 80 extend axially through the fluid nozzle 60 radially outwardly from the fluid inlet passage 58, and are also supplied with air when the gun is triggered on and the air valve means 36 is opened. Air flowing through the passages enters an annular chamber 82 between a front face 86 of the air cap 72 and fluid nozzle, from which it flows through a circular atomizing air orifice 84 surrounding the fluid outlet passage 64 and through a pair of atomizing air orifices 88*a–b*.

FIG. 4 shows the condition of the spray gun 20 when it is off, at which point the air valve means 36 is closed and the fluid valve means 38 also is closed by reason of the fluid valve stem 38 being moved forwardly so that its valve 48 is against the fluid nozzle seat 62.

Figure 6:
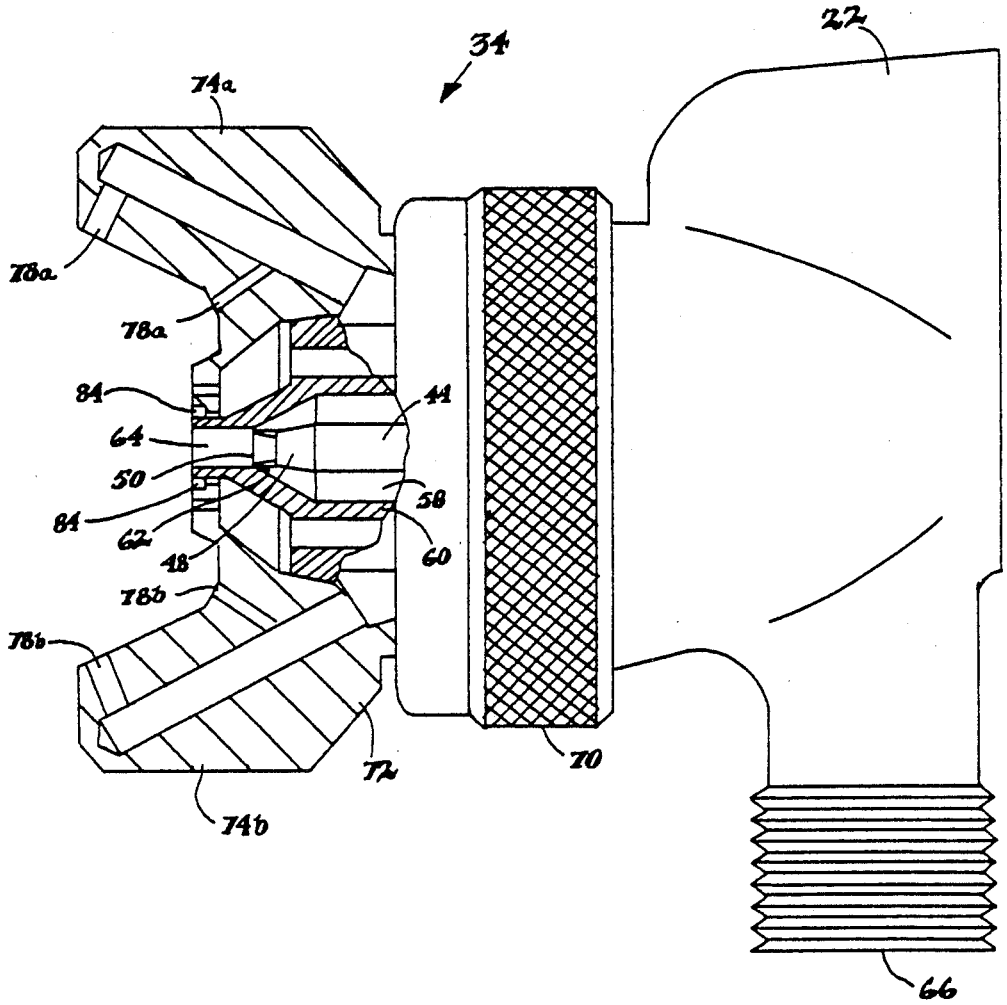
FIG. 6 is similar to FIG. 4, except that the fluid valve stem is shown in its open position.

FIG. 6 illustrates the condition of the spray gun 20 when it is triggered on, at which time the air valve means 36 is open, as is the fluid valve means by reason of the fluid valve stem 38 being retracted to move its valve 48 off of the fluid nozzle valve seat 62 for a flow of coating material through and out of the fluid outlet passage 64. When the stem is retracted, its triangular-shaped forward end 50 does not move out of, but rather remains within, the fluid outlet passage. Consequently, coating material flows from the fluid inlet passage 58, through the valve seat, around the triangular-shaped forward stem end and through the space between the forward stem end and the surface of the fluid outlet passage, and is formed into a hollow cylindrical stream of coating material that is emitted from the spray head 34. As it exits the spray head, the hollow cylindrical stream of coating material is surrounded by a cylindrical stream of atomizing air emitted from the circular atomizing air orifice 84, which breaks up the coating material into an atomized and conically expanding spray. It is usually desirable for the atomized spray to have a fan-shape, and for the purpose air from the opposed side port air orifices 78*a–b* is directed against opposite sides of the conical spray to flatten it into a fan-shaped pattern, with the flow rate of side port air, and therefore the degree of flattening, being determined in a conventional manner by adjustment of an air flow control knob 90 (FIG. 1).

By virtue of the coating material being emitted from the spray head 34 in a hollow cylindrical stream, it is considerably easier to pneumatically break up and atomize into a spray than is a solid cylindrical stream of coating material that would be emitted from an air spray gun having a conventional fluid needle valve. Consequently, effective and satisfactory atomization of the coating material can be obtained with a lower pressure and volume flow of air at the spray head than would normally be required. As a result, there is less fogging of the spray particles, an increased percentage of the particles strike and adhere to the target, and the spray gun has an increased transfer efficiency. Advantageously, the improved fluid valve stem enables effective atomization of the coating material to be achieved with a pressure of air at the spray head of 10 psi or less, so that an air spray gun equipped with it will meet the requirements of certain environmental protection agencies, such as those in California, which require as a condition for use of a spray gun that it be tested to meet at least a specified minimum transfer efficiency, but automatically exempt a gun from testing if the pressure of air at its spray head is 10 psi or less.

While one embodiment of the invention has been described in detail, various modifications and other embodiments thereof may be devised by one skilled in the art without departing from the spirit and scope of the invention, as defined in the appended claims.

I claim:

1. A method of spraying liquid coating material, comprising the steps of emitting a hollow stream of liquid coating material from a spray head; and emitting air from the spray head to break up the hollow stream of coating material into an atomized spray, said step of emitting a hollow stream of coating material comprising delivering coating material to a fluid valve in the spray head, opening the fluid valve for flow of coating material past the fluid valve, through a fluid passage in the spray head and out of an outlet from the fluid passage, and configuring a portion of the fluid valve disposed upstream from the fluid passage outlet to form coating material flowing therepast and through the fluid passage into a hollow stream for emission from the fluid passage outlet.

2. A method as in claim 1, wherein the portion of the fluid valve is disposed within the fluid passage, said fluid passage is cylindrical, said configuring step comprises providing the portion disposed within the fluid passage with a generally triangular shape in cross section perpendicular to the length of the fluid passage, and said step of opening the fluid valve causes coating material to flow around the triangular-shaped portion and between the portion and an inner surface of the fluid passage for emission from the fluid passage outlet in a hollow cylindrical stream of coating material.

3. A method as in claim 1, wherein said step of emitting air comprises delivering air to an atomizing air orifice in the spray head for emission therefrom.

4. A method as in claim 3, wherein the atomizing air orifice is circular and surrounds the fluid passage outlet so that air emitted therefrom breaks up the hollow coating material stream into a conically expanding atomized spray, and including the step of directing air against opposite sides of the conical spray to flatten and shape the spray.

5. A method of spraying liquid coating material, comprising the steps of delivering liquid coating material to an inlet to a fluid nozzle in a spray head, the fluid nozzle having a fluid outlet passage and a valve seat between the inlet and fluid outlet passage; extending a valve stem into the fluid nozzle, the valve stem having a forward end extended into the fluid outlet passage and a valve, rearwardly of the forward end, adapted for movement against and away from the valve seat; moving the valve stem to move the valve against the valve seat to interrupt communication between the fluid nozzle inlet and fluid outlet passage and to move the valve away from the valve seat to establish communication between the fluid nozzle inlet and fluid outlet passage for a flow of coating material from the inlet, past the valve seat, around the forward end of the valve stem and between the forward end and a surface of the fluid outlet passage, and through the fluid outlet passage for exit therefrom and from the spray head in a stream; forming the coating material flowing around the valve stem forward end and between the forward end and fluid outlet passage surface into a hollow stream of coating for emission from the spray head; and emitting air from the spray head to break up the hollow cylindrical stream of coating material into an atomized spray.

6. A method as in claim 5, wherein said forming step comprises maintaining the forward end of the valve stem in the fluid outlet passage when the valve is moved away from the valve seat, and configuring the forward end so that coating material flowing around the forward end and between the forward end and fluid outlet passage surface is shaped into a hollow stream.

7. A method as in claim 6, wherein the fluid outlet passage is cylindrical and said configuring step comprises providing the valve stem forward end with a generally triangular shape in cross section perpendicular to the length of the fluid outlet passage.

8. A method as in claim 5, wherein said air emitting step comprises delivering air to an atomizing air orifice that is in the spray head and surrounds the fluid outlet passage.

9. A method as in claim 8, wherein said step of delivering air provides air at the atomizing air orifice at a pressure no greater than about 10 psi.

10. Apparatus for spray coating, comprising a spray head having fluid orifice means and atomizing air orifice means; means for delivering liquid coating material to said fluid orifice means and for emitting the coating material therefrom in a hollow stream; and means for supplying air to said atomizing air orifice means for emission therefrom to break up the hollow stream of coating material into an atomized spray, wherein said fluid orifice means comprises a fluid outlet passage, said delivering means delivers coating material to said fluid outlet passage for flow through said passage and emission from said spray head, and said delivering means includes fluid shaping means in said fluid outlet passage for forming coating material flowing through said passage into a hollow stream for emission from said spray head.

11. Apparatus as in claim 10, including means for directing air against opposite sides of the atomized spray to shape the spray.

12. Apparatus as in claim 10, wherein said fluid shaping means comprises valve means for controlling the flow of coating material through said fluid outlet passage and for forming the flow of coating material within said passage into a hollow stream.

13. Apparatus as in claim 10, wherein said air supplying means provides air to said atomizing air orifice at a pressure no greater than about 10 psi.

14. Apparatus for spray coating, comprising a fluid nozzle having a fluid inlet passage and a fluid outlet passage; means for delivering liquid coating material to said fluid inlet passage for flow through and emission from said fluid outlet passage; fluid shaping means positioned within said fluid outlet passage for forming coating material flowing through and emitted from said outlet passage into a hollow stream; atomizing air orifice means; and means for supplying air to said atomizing air orifice means for emission therefrom to break up the hollow stream of coating material emitted from said fluid outlet passage into an atomized spray.

15. Apparatus as in claim 14, wherein said fluid nozzle has a valve seat between said fluid inlet and outlet passages, said fluid shaping means comprises a fluid valve stem having a forward end extended into said fluid outlet passage and a valve rearwardly of said forward end and adapted for movement against and away from said valve seat, and including means for moving said valve stem to move said valve against said valve seat to interrupt a flow of coating material through said fluid outlet passage and to move said valve away from said valve seat to establish a flow of coating material through said fluid outlet passage while maintaining said valve stem forward end within said fluid outlet passage for a flow of coating material around said valve stem forward end and between said forward end and a surface of said fluid outlet passage, said valve stem forward end being configured to shape coating material flowing therearound and through said fluid outlet passage into a hollow stream.

16. Apparatus as in claim 15, wherein said fluid outlet passage is cylindrical and said valve stem forward end includes means for maintaining said valve stem and fluid outlet passage in substantial coaxial alignment.

17. Apparatus as in claim 15, wherein said fluid outlet passage is cylindrical and said valve stem forward end is configured to be generally triangular in shape in cross section perpendicular to the length of said fluid outlet passage.

18. Apparatus as in claim 15, wherein said fluid outlet passage is cylindrical and said valve stem forward end is triangular in shape and cross section perpendicular to the length of said fluid outlet passage and defines apexes that lie on a circle of slightly smaller diameter than the inside diameter of said fluid outlet passage.

19. Apparatus as in claim 14, wherein said atomizing air orifice surrounds said fluid outlet passage.

20. Apparatus as in claim 14, wherein said supplying means provides air to said atomizing air orifice at a pressure no greater than about 10 psi.

21. A spray coating apparatus, comprising a spray head having a fluid passage and an inlet to and an outlet from said passage, means for delivering coating liquid to said fluid passage inlet for flow through said fluid passage and emission from said fluid passage outlet, and a fluid valve, said fluid valve comprising an elongate stem having a triangular-shaped forward end disposed within said fluid passage, a valve portion rearwardly of said forward end for opening and closing said inlet to said fluid passage, and a rod portion rearwardly of said valve portion.

22. An improved fluid valve as in claim 21, wherein said fluid passage is cylindrical and said forward end is triangular-shaped in cross section perpendicular to the length of said stem.

23. An improved fluid valve as in claim 22, wherein said valve portion comprises a frusto-conical surface on said stem that tapers inwardly toward said forward end of said stem.

* * * * *